United States Patent [19]

Fujio et al.

[11] Patent Number: 4,711,551

[45] Date of Patent: Dec. 8, 1987

[54] DEVELOPING APPARATUS

[75] Inventors: Akihiko Fujio; Hiroshi Iwaki; Kunio Tsuboi; Akihiko Sutoh, all of Hyogo, Japan

[73] Assignee: Sanyo Electric Co., Ltd., Japan

[21] Appl. No.: 907,738

[22] Filed: Sep. 10, 1986

[30] Foreign Application Priority Data

Sep. 13, 1985 [JP] Japan ..... 60-204148
Nov. 19, 1985 [JP] Japan ..... 60-177604

[51] Int. Cl.[4] ..... G03G 15/08

[52] U.S. Cl. ..... 355/3 DD; 355/14 D; 355/14 R; 118/653

[58] Field of Search ..... 355/3 R, 3 DD, 14 D, 355/14 R; 118/653, 663, 691; 222/DIG. 1

[56] References Cited

U.S. PATENT DOCUMENTS

| | | | |
|---|---|---|---|
| 3,487,978 | 1/1970 | Gawron | 222/DIG. 1 |
| 3,659,556 | 5/1972 | Mutschler | 118/653 X |
| 4,155,638 | 5/1979 | Blitzer | 355/3 DD |
| 4,241,696 | 12/1980 | Huzii | 118/691 |
| 4,370,053 | 1/1983 | Hirayama et al. | 355/14 D |

*Primary Examiner*—A. C. Prescott
*Attorney, Agent, or Firm*—Darby & Darby

[57] ABSTRACT

A developing apparatus comprises a container in which a developer composed of a mixture of carrier and toner is stored and a screw conveyor for transferring and stirring the developer is disposed. The screw conveyor has a stirring blade formed in a spiral shape, and the stirring blade is cut out at nearly the center of the screw conveyor so that stagnation of the developer takes place at that interrupted portion thereof. A level sensor is disposed so as to be able to detect the level of the developer at that interrupted portion. In the interrupted portion, since stagnation of the developer takes place, pulsation of the developer produced in the case of the screw conveyor having a continuous stirring blade is suppressed, and thereby a level of the developer can be detected more accurately. This means that when toner density is increased, fluidity of the developer is reduced, and in the interrupted portion, the level of the developer rises by an amount larger than an increment of volume of the developer due to a relative increase in toner to carrier. In reverse, when the toner density is reduced, the fluidity of the developer is increased, and in the interrupted portion, the level of the developer falls by an amount larger than a decrement of volume of the developer due to a relative decrease in toner to carrier.

11 Claims, 7 Drawing Figures

DEVELOPING APPARATUS

BACKGROUND OF THE INVENTION

1. Field of the Invention

The present invention relates to a developing apparatus. More specifically, the present invention relates to a developing apparatus using a dual-component developer wherein carrier and toner are mixed.

2. Description of the Prior Art

One example of a developing apparatus which is interesting to the present invention is disclosed, for example, in the Japanese Patent Publication No. 19505/1985 published on May 16, 1985.

In this developing apparatus of prior art, swelling of a developer is formed at the central part of a screw conveyor, and a level of this swelling of the developer is detected by level sensing means, and thereby the density of toner to carrier is detected. This prior art has a disadvantage that the swelling of the developer at the central part of the screw conveyor not always reflects accurately the toner density, and accordingly the detection of the toner density is inaccurate.

More specifically, in general, when the toner density is low, fluidity of the developer is increased, and an effect of rotation of a blade becomes large, resulting in a large pulsation of the level. On the other hand, when the toner density is high and the fluidity of the developer is small, the swelling sometimes falls down. Accordingly, the above-described prior art cannot detect an accurate toner density because the level of the developer does not correspond accurately to the toner density.

SUMMARY OF THE INVENTION

Therefore, a principal object of the present invention is to provide a developing apparatus which can detect the toner density more accurately.

To be brief, the present invention is of a developing apparatus comprising stirring means for stirring a developer wherein carrier and toner are mixed while transferring the developer from the starting end to the finishing end thereof, a transfer-interrupted portion formed at a part of a transferring path of the stirring means, and a level sensing means installed at the transfer-interrupted portion for detecting a level of the developer at that portion.

The stirring means stirs the developer while transferring it. Transferring becomes discontinuous at the transfer-interrupted portion, and "stagnation" of the developer is formed at that portion. The level detecting means detects the level of the developer at this stagnant portion. When toner density is increased, fluidity of the developer is reduced, and thereby the level of the developer at the transfer-interrupted portion rises by an amount larger than an increment of volume of the developer due to an increase in toner. In reverse, when the toner density is reduced, the fluidity is increased, and the level at the transfer-interrupted portion falls by an amount larger than an decrement of volume of the developer due to a decrease in toner. Thus, the level of the developer and thus the toner density are detected by the level sensing means.

In accordance with the present invention, for example, no stirring blade or the like exists in the transfer-interrupted portion, and therefore the level of the developer at that part accurately reflects the toner density. For this reason, in accordance with the present invention, the toner density can be detected more accurately in comparison with the conventional methods.

These objects and other objects, features, aspects and advantages of the present invention will become more apparent from the following detailed description of the embodiments of the present invention when taken in conjunction with accompanying drawings.

DESCRIPTION OF THE PREFERRED EMBODIMENTS

Figure 1:
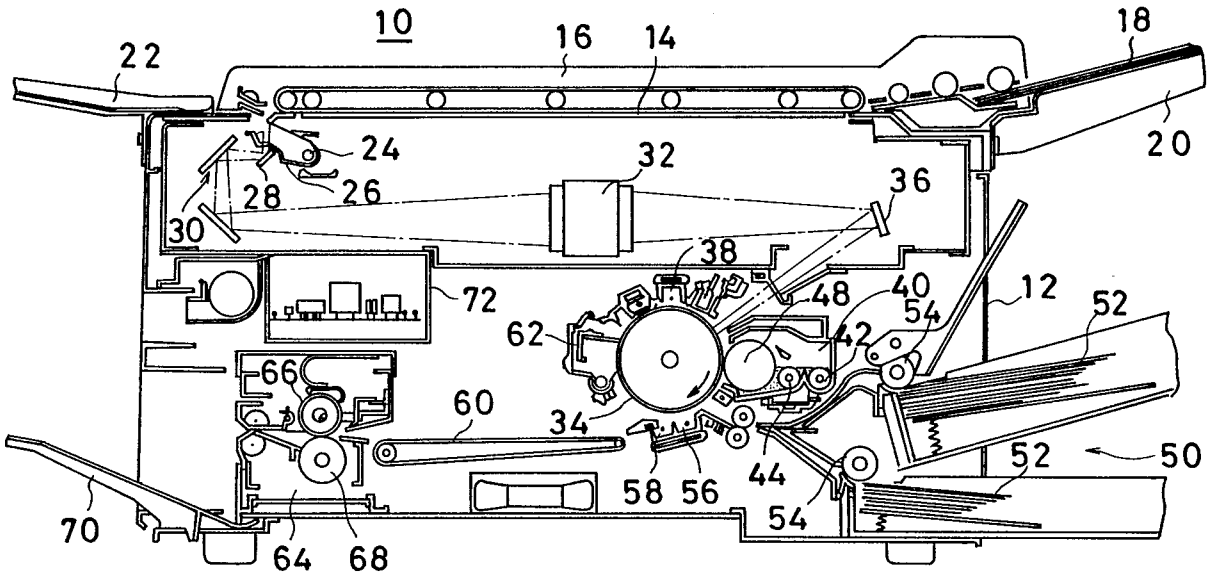
FIG. 1 is an illustrative view showing a structure of an electrophotographic copying machine as one example of an electrophotographic apparatus whereto the present invention is applicable.

FIG. 1 is an illustrative cross-sectional view for explaining an inner structure of an electrophotographic copying machine as one embodiment in accordance with the present invention.

Hereinafter, description is made on the case where the present invention is applied to an electrophotographic copying machine, but it is pointed out in advance that the present invention is applicable also to electrophotographic apparatuses other than such an electrophotographic copying machine, for example, printers and facsimiles.

In reference to FIG. 1, an electrophotographic copying machine 10 includes a copying machine main unit 12, and an original table 14 composed of a transparent glass plate is fixedly installed on the top surface of this copying machine main unit 12. An automatic document feeder 16 is mounted on the top of this original table 14. An original stacking table 20 whereon originals 18 before copying are stored is installed at the starting end of the automatic document feeder 16, and a tray 22 receiving the originals after copying is installed at the finishing end of the automatic document feeder 16.

Under the original table 14 in the copying machine main unit 12, a light source 24 as scanning means for exposing and scanning the original is installed, and this light source 24 can move from one end to the other end of the original table 14 and in the reverse direction thereto. A reflecting mirror 26 having an elliptic cross-section is installed in association with the light source 24. A first movable mirror 28 is fixed to this reflecting mirror 26. When the light source 24 moves forward in the right direction in FIG. 1 by a servo motor, the original placed on the original table 14 is slit-exposured.

A second movable mirror 30 is installed in association with the first movable mirror 28, and this second movable mirror 30 reflects again an original image reflected by the first movable mirror 28 toward a zoom lens 32.

In front of the zoom lens 32, a fixed reflecting mirror 36 for reflecting the original image transmitted through this lens 32 toward a photosensitive-drum 34 is installed.

A charging corotron 38 for uniformly charging the photosensitive-drum 34 in a specific polarity is installed upstream from the exposure position of the photosensitive-drum 34, that is, the position where the original image is projected by the reflecting mirror 36.

A developing apparatus 40 is installed downstream from the above-described exposure position of the photosensitive-drum 34, and an electrostatic latent image formed on this photosensitive-drum 34 by the charging corotron 38, the light source 34 and the zoom lens 32 is developed with toner by this developing apparatus 40. A toner hopper (FIG. 4, described later) for feeding toner is installed above the developing apparatus 40. The developing apparatus 40 further comprises screw conveyors 42 and 44. These screw conveyors 42 and 44 are for stirring carrier and toner. The developing apparatus further incorporates a rotary sleeve 48. The present invention is intended for such a developing apparatus 40.

A paper feeding part 50 is formed at one side end of the copying machine main unit 12, and in this embodiment, two paper feed cassettes are loaded in this paper feeding part 50 in a loadable/unloadable manner. Among papers 52 accommodated in these paper feed cassettes, the uppermost paper is pushed against a paper feed roller 54. The paper feed roller 54 takes-in the paper 52 thus pushed one by one in sequence from this paper feed cassette toward the photosensitive-drum 34 by means of rotation thereof.

A transferring corotron 56 and a separating corotron 58 are installed in a one-piece fashion downstream from the developing apparatus 40.

When the paper 52 is fed from the paper feeding part 50, a toner image formed on the photosensitive-drum 34 is transferred onto the paper 52 by the transferring corotron 56. In transferring the image by this transferring corotron 56, the paper is attracted to the drum 34 and is about to move together with this drum 34, but is separated by the separating corotron 58, being carried toward a vacuum conveyor 60 as described later.

A cleaning apparatus 62 is installed downstream from the transferring corotron 56 (upper left in FIG. 1) along the photosensitive-drum 34, and this cleaning apparatus 62 removes the toner left on the photosensitive-drum 34 after transferring.

The paper separated from the photosensitive-drum 34 by the separating corotron 58 is sent to a fixing apparatus 64 by the vacuum conveyor 60. This fixing apparatus 64 comprises a heating roller 66 incorporating a heater and a press roller 68 for bringing the paper in press-contact with this heating roller 66. Accordingly, the toner image transferred onto the paper 52 is heated and pressed by the two rollers 66 and 68 to be fixed onto the paper 52. The paper after fixation is discharged onto a copy receiving tray 70 by a pair of paper discharge rollers.

A control box 72 is formed above the fixing apparatus 64 in the copying machine main unit 12, and this control box 72 incorporates electronic components for a control system.

Figure 2:
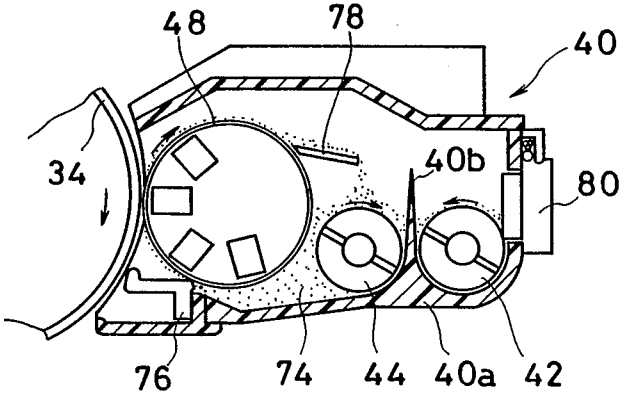
FIG. 2 is an illustrative view showing one embodiment in accordance with the present invention.

In reference to FIG. 2, the developing apparatus 40 installed in the vicinity of the photosensitive-drum 34 comprises a container **40*a*, and in this container 40*a*, a developer 74 is stored and the screw conveyors 42 and 44 are disposed so that the longitudinal directions thereof are parallel with each other. A partition wall 40*b* is formed between these screw conveyors 42 and 44. This partition wall 40*b* partitions respective transferring paths formed by the screw conveyors 42 and 44. A starting end of the screw conveyor 42 communicates with a finishing end of the screw conveyor 44, and a finishing end of the screw conveyor 42 communicates with a starting end of the screw conveyor 44. That is, the both ends of the screw conveyors 42 and 44 communicate with each other. The screw conveyor 42 stirs developer 74 while transferring it from this side in the direction orthogonal to the paper face and the screw conveyor 44 stirs the developer while transferring it in the direction reverse to the case of the screw conveyor 42**.

Thus, the developer 74 mixed and stirred by the two screw conveyors 42 and 44 is absorbed on the rotary sleeve 48 in accordance with the rotation of the rotary sleeve 48, and the absorbed developer is formed as a magnetic brush. Ears of the magnetic brush are brought in contact with the surface of the photosensitive-drum 34, and thereby, for example, the toner charged in negative polarity is attracted the electrostatic latent image is charged in positive polarity, and the electrostatic latent image is developed by the toner. At this time, the height of the ears of the magnetic brush is defined by a blade 76. In addition, the magnetic brush after developing is scraped off the rotary sleeve 48 by a scraper 78 in accordance with the rotation of the rotary sleeve 48.

In association with the screw conveyor 42, a level sensor 80 is installed at a predetermined position of the container **40*a* of the developing apparatus 40. In this embodiment, a pressure sensor of load cell system is utilized for the level sensor 80**.

Figure 3:
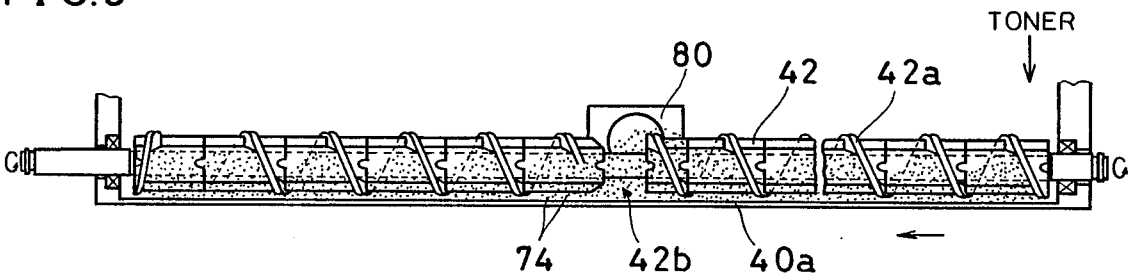
FIG. 3 is an illustrative view showing one example of a screw conveyor of FIG. 1 embodiment.

In reference to FIG. 3, one screw conveyor 42 is illustrated. Toner fed from a toner hopper 82 (FIG. 4) is dropped on the starting end of the screw conveyor 42. The screw conveyor 42 has the stirring blade **42*a* formed in a spiral shape, and accordingly the fed toner and the carrier stored in the container 40*a* are mixed and stirred while transferred in the direction as shown by an arrow by the stirring blade 42*a* of the screw conveyor 42. The stirring blade 42*a* is cut out at nearly the center of the screw conveyor 42, or is formed in a discontinuous fashion. Then, at the interrupted portion 42*b* of the stirring blade 42*a*, transfer of the developer is interrupted, and there stagnation of the developer 74** takes place.

The level sensor 80 is disposed so as to be able to detect a level of the developer 74 at the interrupted portion **42*b*. As in the case of the present embodiment, when the level sensor 80 is a pressure sensor, if the developer 74 contacts with more than a certain area of the sensing surface of the sensor 80, the sensor 80 detects that the developer 74 is at more than certain level at the stagnant portion, that is, the interrupted portion 42*b***.

Thus, in the interrupted portion **42*b*, stagnation of the developer 74 takes place, and therefore the pulsation of the developer produced in the case of the continuous screw conveyor is suppressed, and thereby the level of the developer can be detected more accurately. More specifically, although the level of the developer 74 at the interrupted portion 42*b* depends also on the intrinsic fluidity of the developer, when toner density is increased, the fluidity of the developer is reduced, and in the interrupted portion 42*b*, the level of the developer 74 rises by an amount larger than an increment of volume of the developer due to a relative increase in toner in respect to carrier. Accordingly, when the developer 74 is at more than a certain level at the interrupted portion 42***b*, the toner density of the developer 74 can be detected to be high enough. In reverse, when the toner density is reduced, the fluidity of the developer 74 is increased, and in the portion 42*b*, the level of the developer 74 falls by an amount larger than a decrement of volume of the developer due to a relative decrease in toner with respect to carrier. Accordingly, when the level of the developer 74 is lower than a certain value at this interrupted portion 42*b*, the toner density is detected to be lower than a predetermined value.

Thus, in this embodiment, the level of stagnation of the developer 74 produced at the interrupted portion 42*b* is detected, and therefore the toner density can be detected precisely.

Meanwhile, in the above-described embodiment, the case of using the pressure sensor for the level sensor 80 is shown, but for the level sensor 80, an arbitrary sensor such as a photo-sensor, magnetic sensor, inductance sensor or a capacitance sensor can be utilized instead of a pressure sensor.

Figure 4:
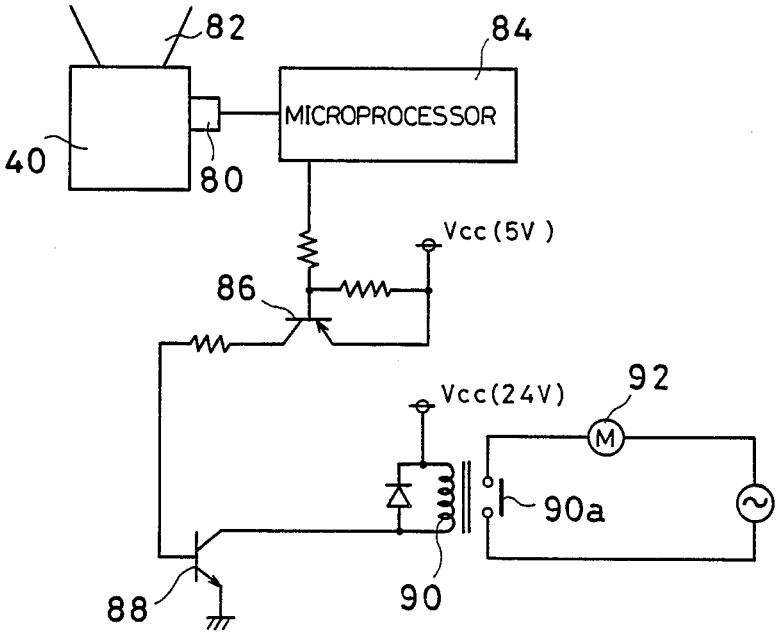
FIG. 4 is a circuit diagram showing one example of a control circuit for controlling feeding of toner.

FIG. 4 is a circuit diagram showing one example of a control circuit for controlling toner density. The toner hopper 82 is installed above the developing apparatus 40, and toner is fed to the starting end of the screw conveyor 42 from this toner hopper 82 as shown in FIG. 3. A signal from the level sensor 80 installed in this developing apparatus 40 is given to an input port of a microprocessor 84 through a proper interface. This microprocessor 84, although not illustrated, presides over all operations of the electro-photographic copying machine as shown in FIG. 1, and attention should be paid on that only a portion relating to the toner feed control is depicted in FIG. 4.

A predetermined output port of the microprocessor 84 is connected to the base of a PNP transistor 86 through a proper interface. The collector of this transistor 86 is connected to a power source Vcc (for example, 5 V), and the emitter is connected to the base of an NPN transistor 88. The emitter of the transistor 88 is grounded, and a relay coil 90 is connected between the collector and a power source Vcc (for example, 24 V). A relay contact 90*a* associated with this relay coil 90 constitutes a power circuit of a motor 92. This motor 92 is for feeding the toner from the previous toner hopper 82 into the developing apparatus 40, and when this motor 92 is rotated by a certain number of rotations, a certain amount of toner is replenished into the developing apparatus 40 from the toner hopper 82.

When the signal from the level sensor 80 is high, that is, when the level of the developer 74 at the interrupted portion 42*b* (FIG. 1) is more than a certain value, the microprocessor 84 does not perform control for toner replenishment.

In reverse, when the signal from the level sensor 80 is low, that is, the level of the developer 74 at the interrupted portion 42*b* is less than a certain value, the microprocessor 84 outputs a low-level signal to the output port thereof. Responsively, the transistor 86 is turned on, and the transistor 88 is turned on. When the transistor 88 is turned on, the relay coil 90 is energized, and the relay contact 90*a* thereof is turned on. Consequently, the motor 92 is energized and a predetermined amount of toner is fed to the developing apparatus 40 from the toner hopper 82.

Thus, the toner density in the developing apparatus 40 is controlled based on the output from the level sensor 80.

Figure 5:
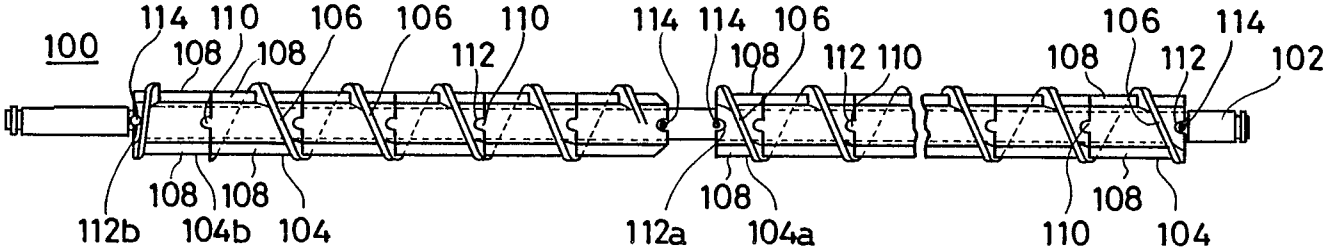
FIG. 5 is an illustrative view showing another example of the screw conveyor.
Figure 6:
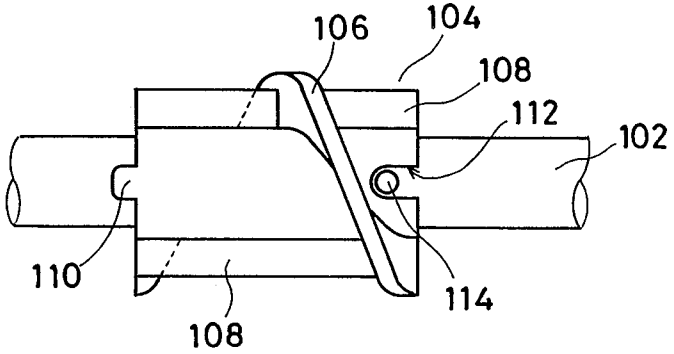
FIG. 6 is an illustrative view showing a screw conveyor unit.
Figure 7:
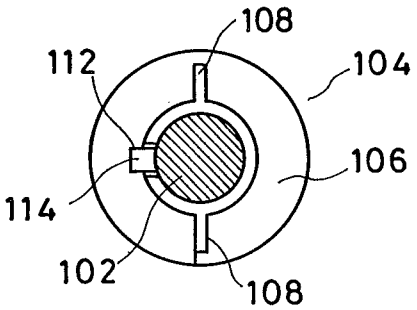
FIG. 7 is a right side view of the screw conveyor unit as shown in FIG. 6.

FIG. 5 through FIG. 7 show another example of the screw conveyor. This screw conveyor 100 comprises a cylindrical shaft 102 composed of metal, and a plurality of screw conveyor units 104, 104, --- are fitted continuously to this shaft 102. This screw conveyor unit 104 is formed with plastics such as polyethylene or polyacetal, and a spiral stirring blade 106 and an auxiliary stirring blade 108 extending in a direction orthogonally intersecting a transferring direction of the developer virtually for one pitch are molded in a one-piece fashion, as shown in FIG. 6. Also, a convex part 110 is formed at one end of the screw conveyor unit 104, and a concave part 112 wherewith the convex part 100 can engage is formed at the other end. Pins 114, 114, --- which can engage with the concave parts 112 of the screw conveyor units 104 are formed at predetermined positions on the shaft 102, and the screw conveyor units 104 are fixed to the shafts 102 by these pins 114.

Then, in this embodiment, the spiral stirring blade 106 for one pitch is not formed in every screw conveyor unit 104, and a spiral stirring blade 106*a* for a half pitch is formed in a screw conveyor unit 104*a* being arranged at the center portion.

Also, the convex part 110 is not formed in every screw conveyor unit 104, and in the above-described screw conveyor unit 104*a* at the center portion and a screw conveyor unit 104*b* at the left end, concave parts 112*a* and 112*b* are formed at both ends thereof. One of the concave parts 112*a* engages with the pin 114.

Meanwhile, in this embodiment, part of the shaft 102 is exposed, and the screw conveyor unit 104 is not fitted to that exposed portion. Accordingly, transferring and stirring of the developer 74 are interrupted at that portion likewise the previous FIG. 3 embodiment.

In the conventional screw conveyor, the spiral stirring blade is molded in one-piece with the shaft by plastics or aluminum die casting, or the metal spiral stirring blade is welded or brazed to the metal shaft. Accordingly, in manufacturing the conventional screw conveyor, one-piece molding using a metal mold, welding or the like is utilized, but the one-piece molding requires a large-sized and complicated mold, and the welding or the like not only has a poor production efficiency but also is difficult to manufacture a screw conveyor having a complicated shape.

On the other hand, in an example as illustrated in FIG. 5 through FIG. 7, a plurality of screw conveyor units wherein a spiral stirring blade for one or less than one pitch is formed are fitted to a single shaft to constitute one screw conveyor, and accordingly small-sized screw conveyor units are produced in a large quantity by using a small-sized die or mold, and the screw conveyor units thus produced are combined properly, and thereby variously desired screw conveyors can be realized at low costs. Also, since the process of welding or brazing can be dispensed with, even a screw conveyor having a complicated shape can be manufactured with ease.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developing apparatus for electrophotography comprising:

stirring means for stirring a developer wherein carrier and toner are mixed while transferring the same from a starting end to a finishing end thereof, transfer-interrupted portion formed at a part of a transferring path of said stirring means, and a level sensing means installed at said transfer-interrupted portion for sensing a level of said developer at said transfer-interrupted portion.

2. A developing apparatus for electrophotography in accordance with claim 1, wherein said stirring means includes a stirring blade formed from the starting end to the finishing end thereof, and said transfer-interrupted portion includes a discontinuous portion of said stirring blade.

3. A developing apparatus for electrophotography in accordance with claim 2, wherein said stirring blade is formed in a spiral shape.

4. A developing apparatus for electrophotography in accordance with claim 3, wherein said stirring means includes screw conveyors.

5. A developing apparatus for electrophotography in accordance with claim 4, wherein said screw conveyor includes a shaft and a plurality of screw conveyor units having a cylindrical shape being mounted continuously or intermittently on said shaft.

6. A developing apparatus for electrophotography in accordance with claim 5, wherein said screw conveyor unit has a spiral stirring blade for one pitch or less than one pitch.

7. A developing apparatus for electrophotography in accordance with claim 6, wherein said screw unit includes a convex part formed at one end thereof and a concave part which is formed at the other end thereof and can engage with the convex part.

8. A developing apparatus for electrophtography in accordance with claim 7, wherein said screw unit is molded in one-piece with said spiral stirring blade by plastics.

9. A developing apparatus for electrophotography in accordance with claim 7, wherein said shaft includes pins being able to engage with said concave part of said screw conveyor unit.

10. A developing apparatus for electrophotography in accordance with claim 1, which further comprises toner feeding means for feeding said toner to an end of said stirring means.

11. A developing apparatus for electrophotography in accordance with claim 10, which further comprises means for controlling toner feeding by said toner feeding means in response to an output of said level sensing means.

* * * * *